US007861566B2

(12) United States Patent
Kolbe et al.

(10) Patent No.: US 7,861,566 B2
(45) Date of Patent: Jan. 4, 2011

(54) SHEET-BENDING PRESS FOR MAKING PIPE

(75) Inventors: Manfred Kolbe, Mönchengladbach (DE); Uwe Feldmann, Rommerskirchen (DE); Frank Viegen, Mönchengladbach (DE); Karl Böhmer, Viersen (DE)

(73) Assignee: SMS Meer GmbH, Monchengladbach (DE)

( * ) Notice: Subject to any disclaimer, the term of this patent is extended or adjusted under 35 U.S.C. 154(b) by 229 days.

(21) Appl. No.: 12/006,590

(22) Filed: Jan. 3, 2008

(65) Prior Publication Data

US 2008/0163660 A1 Jul. 10, 2008

(30) Foreign Application Priority Data

Jan. 4, 2007 (DE) ..... 10 2007 001 625
Dec. 13, 2007 (DE) ..... 10 2007 060 546

(51) Int. Cl.
*B21D 39/02* (2006.01)
*B21D 5/04* (2006.01)
*B21D 31/00* (2006.01)

(52) U.S. Cl. ..... 72/51; 72/308; 72/369; 72/389.8

(58) Field of Classification Search ..... 72/51, 72/52, 176, 178, 305, 308, 368, 369, 389.1, 72/389.6, 389.8
See application file for complete search history.

(56) References Cited

U.S. PATENT DOCUMENTS

| | | | | |
|---|---|---|---|---|
| 3,635,064 | A * | 1/1972 | Chang | 72/178 |
| 3,677,057 | A * | 7/1972 | MacKenzie | 72/305 |
| 3,911,706 | A | 10/1975 | Davis | 72/56 |
| 6,494,360 | B1 | 12/2002 | Flehmig | 228/173.6 |

FOREIGN PATENT DOCUMENTS

| | | |
|---|---|---|
| DE | 2701207 | 3/1978 |
| JP | 5031534 | 2/1993 |

* cited by examiner

*Primary Examiner*—Teresa M Bonk
(74) *Attorney, Agent, or Firm*—Andrew Wilford

(57) ABSTRACT

A bending press for making tubing from a substantially planar and longitudinally extending metal sheet has a support extending transversely generally parallel to the sheet vertically offset from the sheet, and a bender at one of the edges of the sheet and slidable transversely generally parallel to the sheet on the support. The bender has a pair of bending tools, a tie rod extending transversely in the direction adjacent the pair of tools, and an actuator braced transversely in the direction between the tie rod and the tools and extensible in the direction to tension the rod and press the tools against opposite faces of the sheets at the one edge to deform the one edge. A clamp is engageable between the bender and the support for releasably locking the bender to the support at any of a plurality of positions offset transversely therealong generally parallel to the sheet.

9 Claims, 2 Drawing Sheets

SHEET-BENDING PRESS FOR MAKING PIPE

CROSS REFERENCE TO RELATED APPLICATIONS

This application claims the priorities of German patent applications 10 2007 001 625.7 filed 4 Jan. 2007 and 10 2007 060 546.5 filed 13 Dec. 2007.

FIELD OF THE INVENTION

The present invention relates to a sheet-bending press. More particularly this invention concerns such a press used to make pipe.

BACKGROUND OF THE INVENTION

A press is used to bend a metal sheet during the manufacture of pipe or tubing from the metal sheet. This metal sheet extends in a longitudinal plane and is bent at least one longitudinal edge, to which end the bending press has at least one two-part bender that is connected to at least one actuator, and a force acting between the two parts of the bender and generated by the actuator is transmitted through at least one tie rod.

In the fabrication of welded pipes, in particular, of large-diameter pipe, a tubular body is formed in a first step from a sheet plate. In a second step, this body is then welded at the resulting seam of the longitudinal edges of the sheet that are pressed together. In the first process step, the longitudinal edges of the sheet are bent, normally upward. Bending presses for this purpose are well-known.

In a known embodiment, two separate individual presses are employed to bend the two longitudinal edges of the metal sheet. This solution is disadvantageous in that the considerable bending forces laterally shift the workpiece.

In an alternative second embodiment, an approach is thus also known whereby the bending devices for the two edges of the sheet are in one machine, thereby enabling any relative shifting between the two bending devices to be prevented. Accordingly, a fixed frame structure is provided in which the two bending devices are fixed. This approach has disadvantages, however, when the sheet width change. Specifically, in order to adjust the machine to a desired predefined sheet width, the tools are displaced to the required position, i.e., in the case of narrow sheet widths the tools are displaced toward the center of the press. However, it is there that the deformation of the framework-shaped machine is the greatest, with the result that for narrow sheets the deformation is not insignificant in response to the forces exerted by the tools.

OBJECTS OF THE INVENTION

It is therefore an object of the present invention to provide an improved sheet-bending press for making pipe.

Another object is the provision of such an improved sheet-bending press for making pipe that overcomes the above-given disadvantages, in particular that has a stronger machine design that is essentially free of shifting movements on the part of the individual presses, but that nevertheless does not deform in response to the forces exerted by the tools.

Another object of the invention is to provide a bending press of the type described above that has within the meaning of the intended object improved bending of the sheet for a pipe, with only minor movements of the machine parts, and, in particular, only minor deformations of the machine during operation accepted. The object is therefore to provide an improved force flow within the bending press along with adjustability to the width of the sheet to be worked.

SUMMARY OF THE INVENTION

A bending press makes tubing from a substantially planar and longitudinally extending metal sheet having two longitudinally extending edges. The press has according to the invention a support extending transversely generally parallel to the sheet vertically offset from the sheet, and a bender at one of the edges of the sheet and slidable transversely generally parallel to the sheet on the support. The bender has a pair of bending tools shiftable in a direction transversely of a plane of the sheet and engageable with opposite faces of the sheet at the one edge, a tie rod extending transversely in the direction adjacent the pair of tools, and an actuator braced transversely in the direction between the tie rod and the tools and extensible in the direction to tension the rod and press the tools against opposite faces of the sheets at the one edge to deform the one edge. A clamp is engageable between the bender and the support for releasably locking the bender to the support at any of a plurality of positions offset transversely therealong generally parallel to the sheet.

Preferably, at least two benders along with the actuators and tie rod are provided that can be disposed symmetrically on the support relative to a center plane of the pres.

The support here is preferably composed of an upper beam and a lower beam that are aligned relative to each other. To this end, at least one centering device can be provided by which the upper beam is aligned relative to the lower beam.

An adjuster is advantageously provided, in particular, a threaded-spindle arrangement, by means which the unit composed of a bender, an actuator and a tie rod is displaced perpendicular to the longitudinal axis on the support, i.e. can be shifted into the desired position.

A further feature of the invention is that a clamp is provided preferably at an end of the tie rod to clamp the tie rod to the support. The clamp here is preferably designed as a hydraulic piston-cylinder assembly.

In a particularly preferable fashion, provision can be made whereby, on a support composed of upper beam and lower beam, two units composed of bender, actuator, and tie rod form a friction-locked closed framework with the support when the tie rods are in the tensioned state, that is the two support beams form upper and lower horizontal members of the frame and the two tie rods form the vertical members of the frame. This advantageously prevents any shifting of the two tools relative to each other.

Provision can furthermore be made whereby multiple subassemblies, which are each composed of two benders, two actuators, two tie rods, and a support composed of an upper beam and a lower beam, are disposed in succession in the direction of the normally horizontal longitudinal axis. In this case, the multiple units can be connected to each other by means of at least one longitudinally extending stiffening element or bar.

Finally, a preferred embodiment provides that at least one tie rod, one support, and one cross member are clampable to each other by a clamp.

Any relative shifting movement between two presses can thus be advantageously prevented since the machine concept, when used as intended, is based on a closed framework. Since the tie rod for transmitting the tool forces is located in the immediate proximity of the location where the working forces (bending forces) act, any deformations of the machines can be kept to a minimum as compared to the known solutions, i.e. locating the tools close to the line along which the bending force is generated, in other words, always near the tie rods.

The framework structure is thus utilized to prevent shifting, where given a workpiece-format change (i.e. a change in the width of the sheet to be bent) the tie rods are moved along with the tools and the actuator such that the tie rods are always disposed directly where force is applied or as close as possible thereto.

The tensioning of the tie rods is preferably effected through hydraulically actuated tensioning nuts. Provision can be made here whereby the force in the tensioning nut is applied permanently, or whereby in the event the force from the tensioning nut is removed the tensioned state can be maintained by lock-nut fixation or attaching intermediate plates. The tie rods are released in order to displace the tie rods along with the actuators perpendicular to the longitudinal axis of the sheet.

If the tensioning nuts of the tie rods are permanently acted upon by hydraulic oil, the possibility exists of measuring the oil pressure, and thereby also monitoring the pretension of the tie rods.

Due to the framework structure, the proposed-concept has the advantage that the tie rods are always located in the proximity of the tools (i.e. at the point force is applied). This means there is a short force flow. Any deformation of the framework has only a very slight effect on the bending of the sheet.

Depending on the sheet width of the sheet to be bent, the tie rods are first released (de-tensioned) and then displaced perpendicular to the longitudinal axis of the sheet into the new position for optimal bending of the sheet. In this position, the tie rods are again locked by the respective clamps that for this purpose are designed as a quick-acting clamps.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
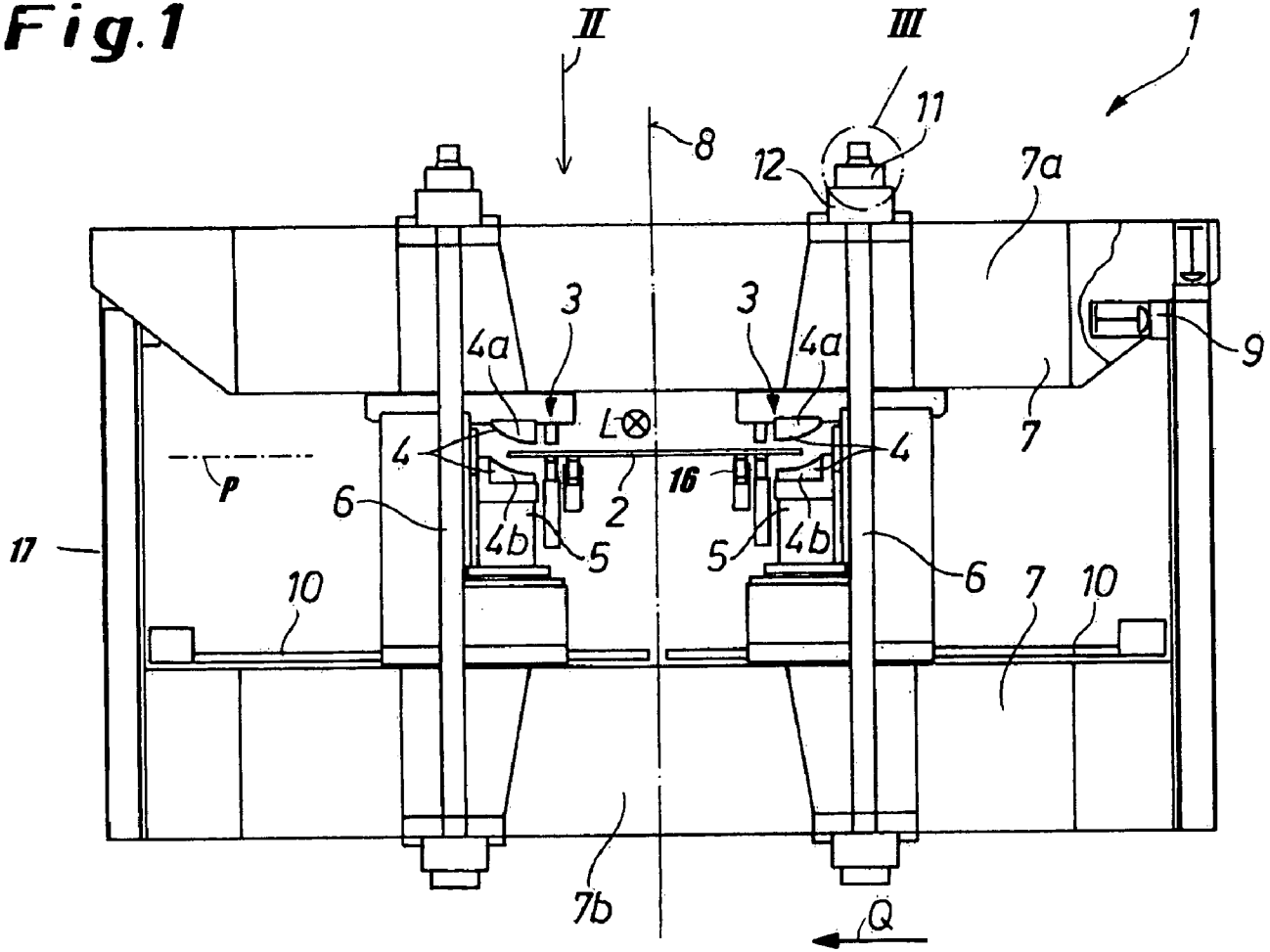
FIG. 1 is a front-end view of the press according to the invention.

A bending press 1 serves to shape a flat steel sheet 2 (FIG. 1 only) into a tubular body by upwardly bending longitudinally extending edges 3 of the sheet 2. Prior to the bending, the sheet 2 lies in a horizontal and longitudinal plane P extending longitudinally and horizontally in a direction L. A roller-type conveyor 16 can displace the sheet 2, which may be continuous, through the press 1 in steps in the horizontal direction L.

Figure 2:
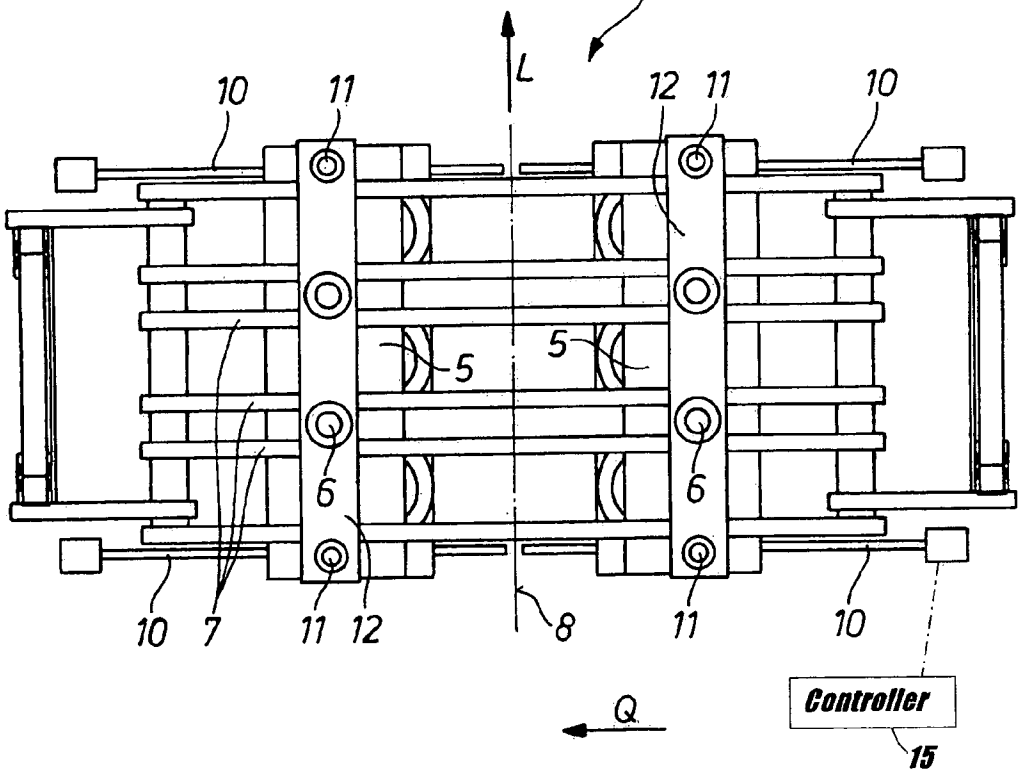
FIG. 2 is a top view of the press taken in the direction of arrow II of FIG. 1.

The press 1 has two benders 4 or a larger number of benders 4 spaced apart in the direction L as shown in FIG. 2. Each bender 4 has two complementary tools 4*a* and 4*b*. Here each upper tool 4*a* is downwardly concave to the respective lower tool 4*b* is upwardly complementarily convex. To bend the sheet 2, the two tools 4*a* and 4*b* of the benders 4 are pressed together, with the respective edge 3 of the sheet 2 between them, thereby plastically deforming the edge into an upwardly arcuately bent shape. The force required for this purpose is generated by a respective actuator 5 that is typically designed as a hydraulic piston-cylinder unit. Transmission of the force from the actuator 5 is through a plurality of tie rods 6 that extend vertically through the bending press 1, here four rods 6 in a row to each side of a center plane 8 of the press 1. Each rod 6 has a lower end that bears upward via the respective actuator 5 on the lower tool 4*b* and an upper end that bears downward on the respective upper tool 4*a*.

The assembly comprised of a bender 4, an actuator 5, and at least one tie rod 6 is displaceable in a horizontal direction Q perpendicular to the center plane L on a support 7 that is comprised of an upper beam 7*a* and a lower beam 7*b* secured together by vertical end posts 17. The beams 7*a* and 7*b* here extend horizontally and transversely of the direction Q and are plates of relatively small thickness in the direction L but relatively great height measured vertically, such that high bending moments can be accommodated with low deformation. Precise positioning of the upper beam 7*a* relative to the lower beam 7*b* is effected by respective centering devices 9 operated by a controller 15 also connected to the spindle adjusters 10. One such centering unit 9 is provided at each end of the upper beam 7*a* and has a horizontally effective small piston-cylinder unit and a vertically effective piston-cylinder unit engaging the upper end of the respective post 17 to effect a fine adjustment of the upper beam 7*a* relative to the lower beam 7*b*, although such units could also provided instead or additionally on the lower beam 7*b*.

Figure 3:
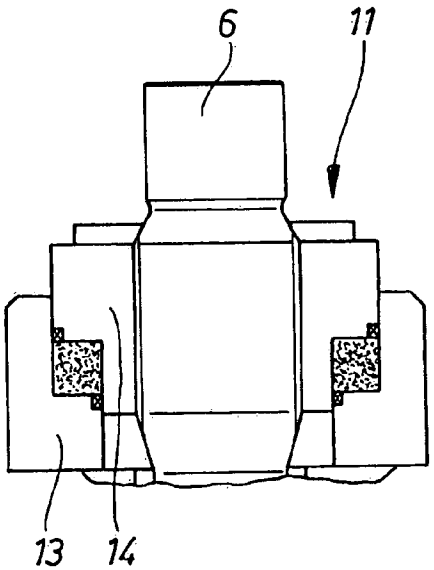
FIG. 3 is a large-scale sectional view of the detail indicated at III in FIG. 1.

Each unit comprised of a bender 4, an actuator 5, and a tie rod 6 can be locked by means of a respective clamp 11 to the respective support 7. The clamp 11 here is a fast-action hydraulic unit. As the detail view of FIG. 3 illustrates, the clamps 11 each have a cylinder 13 riding on the upper beam 7*a* of the support 7 and in which a piston 14 fixed to the respective tie rod 6 is vertically shiftable. This way, the hydraulic clamping force can be exerted on the tie rod 6 to press the upper and lower ends of the tie rod against the upper and lower beams 7*a* and 7*b* and thereby lock the respective bender 4 and actuator 5 against displacement in the transverse direction Q. The units comprised of a bender 4, an actuator 5, and a tie rod 6 are provided symmetrically flanking the center plane 8 so as to enable the two longitudinal edges 3 of the sheet 2 to be bent simultaneously.

As seen in FIG. 2, stiffening members or beams 12 extend longitudinally to each side of the center plane L, with all the tie rods 6 extending through them at longitudinal spacings and the beams 7*a* and 7*b* carried on them. This way all of the benders 4 and actuators 4 on each side of the plane 8 move jointly in the direction Q.

In order to adjust the bending press 1 to a predefined sheet width, the clamps 11 are released to unlock the subassembly of tie rod 6 and cross member 12 from the beams 7*a* and 7*b*. A respective threaded spindle 10, which functions as a linear actuator, then steplessly displaces the units comprised of bender 4, actuator 5, and tie rod 6, in the direction Q symmetrically relative to the center plane 8 until they are in the desired position. After this, the clamps 11 are actuated once again, thereby relocking the components together. The result is a strong frame structure that is able to accommodate the working forces of the tools with little deformation.

We claim:

1. A bending press for making tubing from a substantially planar and longitudinally extending metal sheet having two longitudinally extending edges, the press comprising:

an upper support beam and a lower support beam both extending horizontally and transversely of the longitudinal sheet edges with the upper support beam above the sheet and the lower support beam below the sheet;

a pair of benders at respective edges of the sheet, slidable horizontally and transversely to the edges of the sheet on the upper and lower support beams, and each having:

a respective pair of bending tools shiftable in a vertical direction transversely of a horizontal plane of the sheet and engageable with opposite faces of the sheet at the respective edges, a respective tie rod extending transversely in the direction adjacent the respective pair of bending tools, and respective actuator means braced transversely in the direction between the respective tie rod and the respective pair of bending tools and extensible in the direction to tension the respective tie rod and press the respective pair of bending tools against opposite faces of the sheet at the respective edge to deform the respective edge, each tie rod having one end slidable on one of the upper and lower support beams and an opposite end bearing via the respective actuator means on the other one of the upper and lower support beams; and respective clamping means engageable between the benders and the upper and lower support beams for releasably locking each of the benders to the upper and lower support beams at any of a plurality of positions offset transversely of the edges of the sheet.

2. The press defined in claim 1, wherein each actuator means includes a respective vertically piston-and-cylinder unit.

3. The press defined in claim 1, further comprising frame elements substantially fixing the upper support beam relative to the lower support beam.

4. A bending press for making tubing from a substantially planar and longitudinally extending metal sheet having two longitudinally extending edges, the press comprising:

an upper support beam and a lower support beam both extending horizontally and transversely of the longitudinal sheet edges with the upper support beam above the sheet and the lower support beam below the sheet;

a pair of benders at respective edges of the sheet, slidable horizontally and transversely to the edges of the sheet on the upper and lower support beams, and each having:

a respective pair of bending tools shiftable in a vertical direction transversely of a horizontal plane of the sheet and engageable with opposite faces of the sheet at the respective edges, a respective tie rod extending transversely in the direction adjacent the respective pair of bending tools, and respective actuator means braced transversely in the direction between the respective tie rod and the respective pair of bending tools and extensible in the direction to tension the respective tie rod and press the respective pair of bending tools against opposite faces of the sheet at the respective edge to deform the respective edge;

respective clamping means engageable between the benders and the upper and lower support beams for releasably locking each of the benders to the upper and lower support beams at any of a plurality of positions offset transversely of the edges of the sheet; and adjusting means for longitudinally shifting the benders along the upper and lower support beams through the respective positions when the respective clamping means are released.

5. A bending press for making tubing from a substantially planar and longitudinally extending metal sheet having two longitudinally extending edges, the press comprising:

an upper support beam and a lower support beam both extending horizontally and transversely of the longitudinal sheet edges with the upper support beam above the sheet and the lower support beam below the sheet;

a pair of benders at respective edges of the sheet, slidable horizontally and transversely of the edges of the sheet on the upper and lower support beams, and each having:

a respective pair of bending tools shiftable in a vertical direction transversely of a horizontal plane of the sheet and engageable with opposite faces of the sheet at the respective edges, a respective tie rod extending transversely in the direction adjacent the respective pair of bending tools, and respective actuator means braced transversely in the direction between the respective tie rod and the respective pair of bending tools and extensible in the direction to tension the respective tie rod and press the respective pair of bending tools against opposite faces of the sheet at the respective edge to deform the respective edge;

respective clamping means engageable between the benders and the upper and lower support beams for releasably locking each of the benders to the upper and lower support beams at any of a plurality of positions offset transversely of the edges of the sheet; and centering means for adjusting the upper and lower support beams relative to each other.

6. The press defined in claim 5, wherein each clamping means includes a hydraulic actuator.

7. The press defined in claim 6, wherein each hydraulic actuator has a piston fixed to a respective end of the respective tie rod and a cylinder ring on the respective beam.

8. A bending press for making tubing from a substantially planar and longitudinally extending metal sheet having two longitudinally extending edges, the press comprising:

a plurality of upper support beams and a plurality of lower support beams all extending horizontally and transversely of the longitudinal sheet edges with the upper support beams above the sheet and the lower support beams below the sheet;

a plurality of pairs of benders in rows at respective edges of the sheet, slidable horizontally and transversely of the edges of the sheet on the upper and lower support beams, and each having:

a respective pair of bending tools shiftable in a vertical direction transversely of a horizontal plane of the sheet and engageable with opposite faces of the sheet at the respective edges, a respective tie rod extending transversely in the direction adjacent the respective pair of bending tools, and respective actuator means braced transversely in the direction between the respective tie rod and the respective pair of bending tools and extensible in the direction to tension the respective tie rod and press the respective pair of bending tools against opposite faces of the sheet at the respective edge to deform the respective edge; and respective clamping means engageable between the benders and the upper and lower support beams for releasably locking each of the benders to the upper and lower support beams at any of a plurality of positions offset transversely of the edges of the sheet; and respective upper and lower stiffener elements extending longitudinally above the upper support beam and below the lower support beam, the tie rods each having one end secured in one of the stiffener elements and another end engaged via the respective clamping means on the other of the stiffener elements, the clamping means being effective vertically to press the upper stiffener element downward against the upper support beams and the lower stiffener element upward against the lower support beams.

9. A bending press for making tubing from a substantially planar and longitudinally extending metal sheet having two longitudinally extending edges, the press comprising:

an upper support beam and a lower support beam both extending horizontally and transversely of the longitudinal sheet edges with the upper support beam above the sheet and the lower support beam below the sheet;

a pair of benders at respective edges of the sheet, slidable horizontally and transversely of the edges of the sheet on the upper and lower support beams, and each having:

a respective pair of bending tools shiftable in a vertical direction transversely of a horizontal plane of the sheet and engageable with opposite faces of the sheet at the respective edges, a respective tie rod extending transversely in the direction adjacent the respective pair of bending tools, and respective actuator means braced transversely in the direction between the respective tie rod and the respective pair of bending tools and extensible in the direction to tension the respective tie rod and press the respective pair of bending tools against opposite faces of the sheet at the respective edge to deform the respective edge; and respective clamping means each including a hydraulic actuator and engageable between the benders and the upper and lower support beams for releasably locking each of the benders to the upper and lower support beams at any of a plurality of positions offset transversely of edges of the sheet.

* * * * *